US010842338B2

(12) United States Patent
Weis et al.

(10) Patent No.: US 10,842,338 B2
(45) Date of Patent: Nov. 24, 2020

(54) MANUALLY-DISPLACEABLE CLEANING DEVICE HAVING COUNTER-ROTATABLE ROLLERS

(71) Applicant: Carl Freudenberg KG, Weinheim (DE)

(72) Inventors: Norbert Weis, Weinheim (DE); Daniel Baumgart, Worms (DE)

(73) Assignee: CARL FREUDENBERG KG, Weinheim (DE)

( * ) Notice: Subject to any disclaimer, the term of this patent is extended or adjusted under 35 U.S.C. 154(b) by 162 days.

(21) Appl. No.: 15/565,427

(22) PCT Filed: Apr. 21, 2016

(86) PCT No.: PCT/EP2016/058930
§ 371 (c)(1),
(2) Date: Oct. 10, 2017

(87) PCT Pub. No.: WO2016/170073
PCT Pub. Date: Oct. 27, 2016

(65) Prior Publication Data

US 2018/0125321 A1 May 10, 2018

(30) Foreign Application Priority Data

Apr. 24, 2015 (DE) ..... 10 2015 005 229

(51) Int. Cl.
*A47L 11/40* (2006.01)
*A47L 11/282* (2006.01)
*A47L 11/22* (2006.01)
*A47L 11/24* (2006.01)

(52) U.S. Cl.
CPC ..... *A47L 11/4041* (2013.01); *A47L 11/22* (2013.01); *A47L 11/24* (2013.01); *A47L 11/282* (2013.01)

(58) Field of Classification Search
CPC . A47L 11/4038; A47L 11/4041; A47L 11/282
See application file for complete search history.

(56) References Cited

U.S. PATENT DOCUMENTS 3,220,043 A * 11/1965 Lampe ..... A47L 5/34 15/340.2
3,543,321 A * 12/1970 Raia ..... A47L 11/4041 15/50.3
3,729,769 A * 5/1973 Sharpless ..... A47L 7/00 15/347

(Continued)

FOREIGN PATENT DOCUMENTS

AT 50385 B 10/1911
CN 2229788 Y 6/1996

(Continued)

*Primary Examiner* — Michael D Jennings
(74) *Attorney, Agent, or Firm* — Leydig, Voit & Mayer, Ltd.

(57) ABSTRACT

A cleaning device has a main part and a handle with which an operator can displace the cleaning device on a surface being cleaned, two counter-rotatable rollers being received in the main part such that the rollers come into contact with the floor being cleaned, the rollers being arranged in the main part such that they are only separated by a shared air gap and/or longitudinal gap.

18 Claims, 3 Drawing Sheets

(56) References Cited

U.S. PATENT DOCUMENTS

| | | | | | |
|---|---|---|---|---|---|
| 4,426,751 | A * | 1/1984 | Nordeen | A47L 9/0411 | 15/384 |
| 4,624,025 | A * | 11/1986 | Kaulig | A47L 9/0411 | 15/384 |
| 4,845,797 | A * | 7/1989 | Kobayashi | A47L 11/33 | 15/41.1 |
| 5,109,976 | A * | 5/1992 | Mohri | A47L 9/0411 | 15/256.52 |
| 7,150,068 | B1 * | 12/2006 | Ragner | A47L 5/22 | 15/340.2 |
| RE42,155 | E | 2/2011 | Ragner | | |
| 8,443,478 | B2 | 5/2013 | West et al. | | |
| 2002/0092122 | A1 | 7/2002 | Zahuranec et al. | | |
| 2006/0191097 | A1 * | 8/2006 | Baumhakel | A47L 11/24 | 15/320 |
| 2012/0311813 | A1 | 12/2012 | Bursal et al. | | |

FOREIGN PATENT DOCUMENTS

| | | | |
|---|---|---|---|
| CN | 102188197 | A | 9/2011 |
| CN | 103491839 | A | 1/2014 |
| EP | 0039558 | A2 | 11/1981 |
| EP | 0050470 | A1 | 4/1982 |
| WO | WO 2012149572 | A2 | 11/2012 |

* cited by examiner

MANUALLY-DISPLACEABLE CLEANING DEVICE HAVING COUNTER-ROTATABLE ROLLERS

CROSS-REFERENCE TO RELATED APPLICATIONS

This application is a U.S. national stage application under 35 U.S.C. § 371 of International Application No. PCT/EP2016/058930, filed on Apr. 21, 2016, and claims benefit to German Patent Application No. DE 10 2015 005 229.2, filed on Apr. 24, 2015. The International Application was published in German on Oct. 27, 2016, as WO 2016/170073 A1 under PCT Article 21(2).

FIELD

The invention relates to a manually-displaceable cleaning device.

BACKGROUND

U.S. Pat. No. 8,443,478 B1 discloses a cleaning device which is manually displaceable by a handle with the aid of a motor. The cleaning device comprises two counter-rotatable rollers with rotational speeds that can be adjusted independently of one another. The rollers are furnished with brushes. The rollers are arranged next to one another, with a wall structure arranged between the rollers. Dirt particles spun up by a roller can be bounced back and deflected by the wall structure. The rollers can also be removed from the main part for cleaning.

The cleaning device in the prior art includes a wall structure with a relatively complex structure between the cleaning rollers fitted with bristles. This means that the dirt particles spun up by the respective cleaning roller are conveyed independently into the collection vessel without any interaction with the other roller.

As the brushes or their bristles are separated by the wall structure, there is no possibility of interaction between the brushes to convey the collected dirt particles spun up in each case.

The lack of interaction between the brushes in a shared intermediate space means that it is also not possible to achieve a pump action to accelerate the airflow in the conveying direction in such a shared intermediate space between the brushes.

In addition, the brushes are even arranged at such a distance from one another that it is only possible to generate a sufficiently strong suction vacuum above the rollers by using very complex equipment. The design of the brushes is also rather detrimental with regard to creating a suction vacuum.

It is thus not possible to ensure optimum conveyance of the dirt particles and the air surrounding said particles. It is also not easy to generate a suction vacuum which has a significant effect on the direction in which the dust particles are conveyed, increases the cleaning power and also makes it easy to collect or pick up dirt particles.

SUMMARY

An aspect of the invention provides a cleaning device, comprising: a main part; a handle with which an operator can displace the cleaning device on a surface to be cleaned; and a first and a second rotatable roller, the two rollers being counter-rotatable and being received in the main part such that the rollers come into contact with the surface to be cleaned, wherein the rollers are arranged in the main part such that the rollers are only separated by a shared air gap and/or longitudinal gap.

BRIEF DESCRIPTION OF THE DRAWING

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
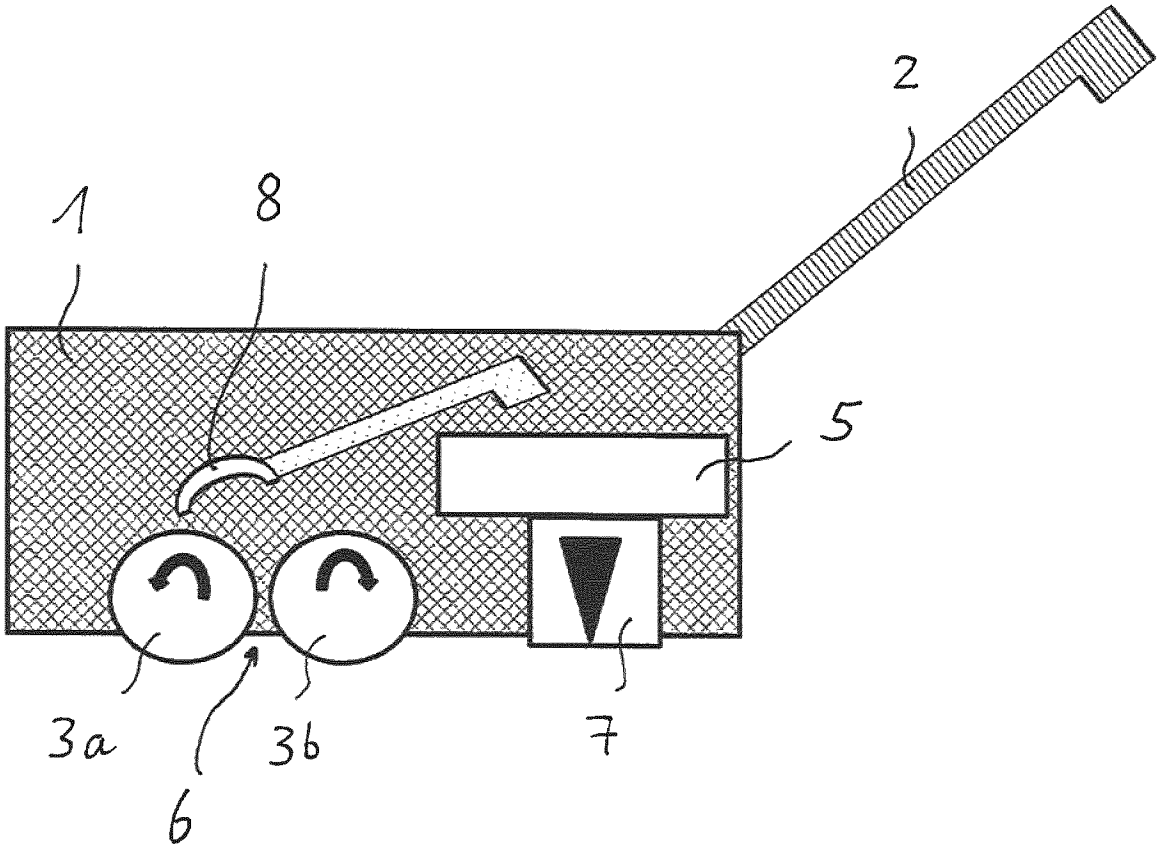
FIG. 1 a side view of a cleaning device.

An aspect of the invention provides a cleaning device with which it is possible to achieve optimum conveyance of particles and the air surrounding said particles to a collection vessel by means of a simple structural design, and in which it is easy to generate a strong suction vacuum to support this conveyance process if necessary.

A cleaning device comprises a main part and a handle with which an operating person can displace said cleaning device on a surface to be cleaned, two counter-rotatable rollers being received in the main part such that both rollers come into contact with the floor to be cleaned. According to an aspect of the invention, the rollers are not separated by a wall structure with the result that they influence a shared longitudinal gap from both sides. In this respect, the rollers are arranged such that they enclose a shared longitudinal gap. The rollers are directly adjacent to one another.

Only a relatively narrow longitudinal gap is provided between the rollers, allowing the rollers to interact with whirled-up and/or sucked-up media such as air or dirt particles in the same direction on both sides of the longitudinal gap. This effect is particularly enhanced by the fact that the rollers are driven in opposite directions.

As both rollers come into contact with the floor to be cleaned, it is possible to prevent dirt particles from spinning beneath the main part as a result of impulse transmission.

In this respect, a cleaning device is described with which it is possible to achieve optimum conveyance of particles and the air surrounding said particles to a collection vessel by means of a simple structural design, and in which it is easy to generate a strong suction vacuum to support this conveyance process if necessary.

The handle is preferably connected to the main part in an articulated manner. In this case the articulated joint may be designed as a universal joint. The cleaning device is driven manually. In this respect, electric drive means for the rollers can be omitted.

The rollers are preferably driven by means of an electric motor. To this end, an electric motor and a storage device, preferably a battery, are arranged in the main part. Force is preferably transmitted to the rollers by means of a traction drive, for example by means of a toothed belt.

If the rollers are the same size, they spin dirt particles upwards. In this case at least some of the dirt particles may again fall directly downwards and collect in an undesirable manner above the longitudinal gap between the rollers.

The rollers could therefore have different diameters. As a result, dirt particles can be directed in a preferred direction which is not perpendicular to the surface to be cleaned. An inclined preferred direction allows the main part to have a small overall height, as the dirt particles can be guided into a collection vessel at an angle.

The ratio between the diameters of the rollers may be between 7:6 and 12:6, preferably 8:6. In an advantageous embodiment of the invention, the larger roller has a diameter of 40 mm and the smaller roller has a diameter of 30 mm. The roller with the larger diameter is preferably assigned to the front edge of the main part. In this embodiment, the roller with the smaller diameter is arranged behind the larger roller and closer to the collection vessel when viewed from the front edge of the main part. In this embodiment of the invention, the collected dirt particles are directed obliquely backwards into the collection vessel arranged in the main part. It was also established that the larger roller loosens the dirt adhering to the floor to be cleaned more effectively than the smaller roller.

In addition, tests revealed that smaller, dust-like impurities are spun more effectively into the collection vessel by rollers with a smaller diameter, while larger particulate impurities are spun into the collection vessel more effectively by rollers with a larger diameter. In this respect it is particularly advantageous if both rollers come into contact with the floor to be cleaned.

The width of a longitudinal gap between the rollers could be in the region of 0.5 mm to 15 mm, or preferably in the region between 1 mm to 10 mm. This thus ensures a high conveying capacity and a high suction vacuum in the region above the longitudinal gap. Dust particles can thus be conveyed and sucked up very effectively.

To further improve the conveying properties, the rollers may be profiled and may engage in the respective profile section.

This being so, the lateral surface could be furnished with at least one roller with a profile. This produces a preferred direction into which dust particles are forced. The profile could cause a pump action to develop.

A profile may be designed in the form of a vane. The angles of profile structures, preferably the angles of profile blades, in relation to the lateral surface of a roller have a considerable influence on the conveying action. A type of vane leads to a particularly effective conveying action.

The profile may be formed by blades. The blades preferably run in the longitudinal direction of the rollers. In order to improve the cleaning action, it is advantageous if the blades are resiliently deformable. To this end, at least the blades may be made from a thermoplastic elastomer (TPE).

The cleaning action can be further improved if the blades are designed to be V-shaped. In this case, the tip of the V-shaped blades is preferably arranged in approximately the center of the roller. In this way, dirt particles that are picked up in the outer region of the rollers are deflected towards the middle of the rollers so that they can be safely conveyed to the collection vessel.

In the region of the minimum distance between the rollers, the blades can merely be separated from one another by a gap running in the longitudinal direction. In an advantageous embodiment the gap width is 1 mm.

An air chamber may form between the blades and the surfaces of the rollers that face one another. At least larger particles are enclosed in the air chamber and conveyed in the direction of the collection vessel.

It would be possible for the lateral surface of at least one roller not to be equipped with bristles or bristle bundles, at least in part. Bristle bundles are unable to seal a closed volume in an intermediate space between the two rollers. There are always gaps between the bristles in the bristle bundles which reduce any pump action. Both rollers should therefore preferably have no bristles or bristle bundles.

The width of the longitudinal gap is defined as follows for profiled rollers: in profiled rollers, there are two profile radii leading out from their axes of rotation, an external profile radius finishing at the tip of the profiled section and an internal profile radius finishing at the base of the profiled section.

If, for example, the profile is 10 mm tall, a longitudinal gap width of 1 mm would mean that the distance from the outermost radial point of the profile to the base of the opposite roller would still be 1 mm if the increased profile is synchronized with the gap. The profiles of the rollers then engage with one another, thus resulting in a good conveying action or pump action.

At least one roller could be resiliently mounted. As a result, the rollers are able to impact against the surface to be cleaned and loosen dirt particles from said surface accordingly.

In another advantageous embodiment of the invention, at least some parts of the rollers are deformable. To this end, at least some parts of the rollers may be furnished with a core made from foam. Due to the deformable embodiment of the invention, the rollers can be adapted to the floor to be cleaned so as to always guarantee that both rollers lie on the floor to be cleaned at least in the region of the profile. In this case, the rollers may be arranged in the main part such that the profile or blades are deformed in the contact region with the floor to be cleaned and thus lie on the floor to be cleaned by means of pretensioning.

It would be conceivable to rotate the rollers at such rotational speeds that the speeds at each of the outermost radial points are identical. This means that the dirt particles spun up by one roller in the direction of the other roller are conveyed effectively by the opposite roller in each case. In addition, any profiles can engage with one another synchronously. A smaller roller thus rotates with a correspondingly higher speed than a larger facing roller. In this respect, the rollers have a corresponding circumferential speed in this embodiment.

However, depending on the purpose of the application, it can also be advantageous if the rollers alternatively have the same rotational speed.

The rollers are preferably operatively connected. In this case, the rollers may also be connected by means of a traction drive or alternatively by toothed wheels. Depending on the purpose of the cleaning device, the transmission ratio may then be selected such that both rollers have the same circumferential speed or alternatively the same rotational speed.

A preferably angled baffle may be arranged above the rollers and/or the longitudinal gap. This makes it possible to deflect the spun dirt particles. The baffle is provided above the rollers in the housing. This helps to guide the dirt particles in a preferred direction, as created by two different sizes of rollers. The conveying action of the suction vacuum is also advantageously supported by the baffle.

The baffle may preferably be designed such that it is curved. To this end, the shape of the baffle may correspond to the shape of the rollers. The dirt particles are directed safely into the collection vessel as a result of the curved embodiment. The curved shape prevents the dirt particles receiving an impulse on contact with the baffle, causing the dirt particles to be spun out of the cleaning device again.

A venting device could be provided in the region behind the rollers. If there is no suction vacuum effect or such an effect is not intended, it can be advantageous to provide venting, preferably in a region behind the rollers, as the rollers can generate an airflow into the cleaning device. An undesirable build-up of pressure caused by the pump action of the rollers can thus be compensated.

It would be conceivable for gaps between the rollers and an enclosing housing to be smaller than the longitudinal gap between the rollers, preferably in at least one position. Otherwise, the conveyed medium can easily escape again in the opposite direction. In addition, larger gaps between the housing and the rollers make it difficult to create a suction vacuum behind the rollers.

Alternatively or additionally, it is also conceivable for the gaps between the housing and the rollers to be closed, at least in part, by a low-friction seal in contact with the rollers.

This seal may be designed in the form of a flexible lip or by additional rollers or by a continuous bristle curtain. Any particles adhering to the rollers can also be removed by this seal.

FIG. 1 shows a cleaning device which comprises a main part 1 and a handle 2 with which an operating person can displace said cleaning device on a surface to be cleaned. The handle 2 is connected to the main part 1 in an articulated manner. Two counter-rotatable rollers 3*a*, 3*b* are received in the main part 1. The rollers 3*a*, 3*b* are arranged such that they influence both sides of a narrow shared longitudinal gap 6. The rollers 3*a*, 3*b* are driven by an electric motor which is arranged in the main part 1 along with a battery. The rollers 3*a*, 3*b* are driven such that both rollers 3*a*, 3*b* have the same circumferential speed.

The rollers 3*a*, 3*b* are arranged such that they are only separated by a shared air gap and/or a longitudinal gap 6. Both rollers 3*a*, 3*b* come into contact with the floor to be cleaned.

Figure 2:
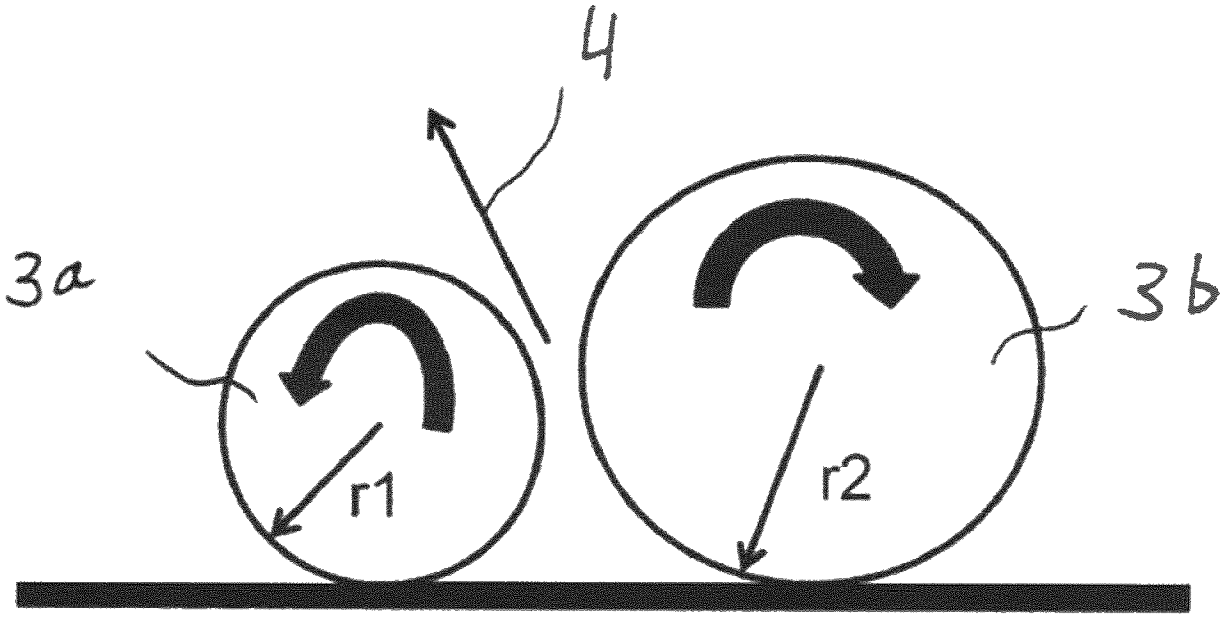
FIG. 2 a schematic view of two counter-rotatable rollers with different diameters.

FIG. 2 shows that the rollers 3*a*, 3*b* have different diameters r1, r2. The roller 3*b* assigned to the front edge of the main part 1 has a diameter r2 of 40 mm and the roller 3*a* located behind the first roller has a diameter r1 of 30 mm. As a result, dirt particles can be directed in a preferred direction 4 which is not perpendicular to the surface to be cleaned. An inclined preferred direction 4 allows the main part 1 to have a small overall height as the dirt particles can be guided into a collection vessel 5 at an angle.

The collection vessel 5 is arranged in the main part 1 and can be removed from the main part 1 by means of a handle to be emptied.

The width of the longitudinal gap 6 between the rollers 3*a*, 3*b* is 1 mm. This causes a particularly good conveying action in relation to the medium to be transported, namely dirt particles and/or air.

In addition, a high vacuum pressure is produced above the longitudinal gap 6 by means of a suitable narrowing of the longitudinal gap 6 in conjunction with a suction unit 7, which causes a rapid airflow through the longitudinal gap 6 and thus a good uptake of dust and dirt particles from the floor.

A baffle 8 is arranged above the rollers 3*a*, 3*b* and the longitudinal gap 6. The baffle 8 is curved and follows the contour of the rollers 3*a*, 3*b*. The baffle 8 forms part of the main part 1, or in other words is part of the housing cover.

Figure 3:
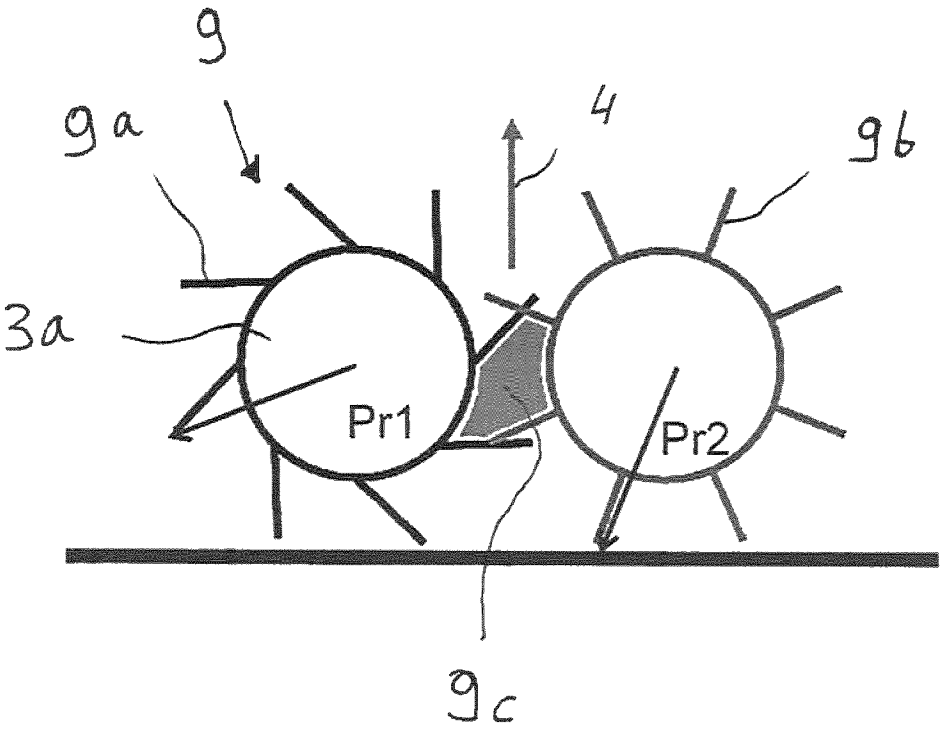
FIG. 3 a schematic view of two counter-rotatable rollers with different profiles. The profiles of the rollers engage with one another, one profile being designed in the form of a vane.

FIG. 3 shows that the lateral surface of at least one roller 3*a* is furnished with a profile 9. This thus creates a particularly good conveying action in the direction of rotation of the rollers 3*a*, 3*b*. The profile 9 could cause a pump action to develop. In specific terms, the profile 9 may be designed in the form of a vane. To this end, the rollers 3*a*, 3*b* are furnished with blades that are resiliently deformable. In addition, some parts of the rollers 3*a*, 3*b* comprise a core made from deformable foam. This means that the rollers 3*a*, 3*b* are deformable and can be adapted to the floor to be cleaned. The blades of both rollers 3*a*, 3*b* are always in contact with the floor to be cleaned, the blades lying on the floor to be cleaned by means of pretensioning and being deformed in part. The blades run in the longitudinal direction of the rollers and are designed to be V-shaped.

The lateral surfaces of the two rollers 3*a*, 3*b* are not furnished with any bristles or bristle bundles at all. Their profile structures, namely profiled blades 9*a*, 9*b*, engage with one another. An air chamber 9*c* is created between two profiled blades 9*a*, 9*b*.

The profiled blades 9*a* are arranged at an angle and protrude in the form of secants from the lateral surface of the roller 3*a*. The profiled blades 9*b* are not arranged at an angle and protrude radially outwards from the axis of rotation of the roller 3*b* in a star shape without any inclination. There are two profile radii Pr1, Pr2.

It is conceivable for at least one roller 3*a*, 3*b* to be resiliently mounted. As a result, the rollers 3*a*, 3*b* are able to impact against the surface to be cleaned and loosen dirt particles from said surface accordingly.

The rollers 3*a*, 3*b* can be rotated at such rotational speeds that the speeds at each of the outermost radial points are identical.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A cleaning device, comprising:

a main part;

a handle with which an operator can displace the cleaning device on a surface to be cleaned; and a first and a second rotatable roller, the two rollers being counter-rotatable and being received in the main part such that the rollers come into contact with the surface to be cleaned, wherein the rollers are arranged in the main part such that the rollers are separated by a shared air gap, wherein each roller includes a lateral surface that is shaped to include mutually engaging profiles, the profiles being formed by the lateral surfaces of the rollers themselves, and wherein at least one roller does not include bristles.

2. The device of claim 1, wherein the rollers have different diameters.

3. The device of claim 2, wherein a ratio between the diameters of the rollers is between 7:6 and 12:6.

4. The device of claim 2, wherein a ratio between the diameters of the rollers is between 7:6 and 8:6.

5. The device of claim 1, wherein a width of the shared air gap between the rollers is in a range of from 0.5 mm to 15 mm.

6. The device of claim 5, wherein a width of the shared air gap between the rollers is in a range of from 1 mm to 10 mm.

7. The device of claim 1, wherein the profile is formed by blades.

8. The device of claim 7, wherein the blades are V-shaped.

9. The device of claim 7, wherein the blades in a region of a minimum distance between the rollers are separated from one another by a gap.

10. The device of claim 7, further comprising:

an air chamber, formed between the blades and surfaces of the rollers that face one another.

11. The device of claim 1, wherein at least one roller is resiliently mounted.

12. The device of claim 1, wherein the rollers are deformable.

13. The device of claim 1, wherein the rollers can be rotated at such rotational speeds that the speeds at each of the outermost radial points are identical.

14. The device of claim 1, further comprising:

a baffle, arranged above the rollers.

15. The device of claim 14, wherein the baffle is further arranged above the shared air gap.

16. The device of claim 1, further comprising:

a venting device, provided behind the rollers.

17. The device of claim 1, further comprising:

a baffle, arranged above at least one of the rollers or the shared air gap.

18. The device of claim 1, wherein each roller does not include bristles.

* * * * *